United States Patent [19]

Jenkins et al.

[11] 3,978,675

[45] Sept. 7, 1976

[54] MINE ROOF SUPPORT EQUIPMENT

[75] Inventors: Philip Peter Jenkins, Cannock; Stanley Lewis, Tickhill, both of England

[73] Assignee: Coal Industry (Patents) Limited, London, England

[22] Filed: Jan. 29, 1974

[21] Appl. No.: 437,707

[52] U.S. Cl. ..... 61/45 F; 61/85

[51] Int. Cl.[2] ..... E01G 3/00

[58] Field of Search ..... 61/45 D, 45 F, 84, 85; 299/31, 33

[56] References Cited

UNITED STATES PATENTS

| | | | |
|---|---|---|---|
| 540,306 | 6/1895 | Fry | 299/31 |
| 2,716,025 | 8/1955 | Malloy et al. | 299/33 |
| 3,250,078 | 5/1966 | Kemper | 61/85 |
| 3,387,892 | 6/1968 | Fischer et al. | 299/31 |
| 3,508,408 | 4/1970 | LeJeune | 61/45 F |
| 3,613,383 | 10/1971 | Fiske | 61/85 |
| 3,788,087 | 1/1974 | Patin | 61/42 |
| 3,823,566 | 7/1974 | Handewith | 61/85 |

FOREIGN PATENTS OR APPLICATIONS

| | | | |
|---|---|---|---|
| 669,699 | 4/1963 | Canada | 61/45 F |
| 1,271,744 | 7/1968 | Germany | 61/85 |
| 1,034,537 | 6/1966 | United Kingdom | 61/45 F |
| 876,872 | 9/1961 | United Kingdom | 61/45 F |
| 862,210 | 3/1961 | United Kingdom | 61/45 F |

*Primary Examiner*—Jacob Shapiro
*Attorney, Agent, or Firm*—James C. Wray

[57] ABSTRACT

Roof support equipment for a mining machine comprises a canopy supporting plurality of deformable, inflatable bags which can be temporarily deflated to allow advance of the equipment. The canopy is mounted on a movable base which may be constituted by the mining machine.

5 Claims, 6 Drawing Figures

MINE ROOF SUPPORT EQUIPMENT

This invention relates to mine roof support equipment which temporarily supports roofs formed in underground mines by the extraction of rock from working faces and which are repeatedly advanced as the working face advances.

In particular, although not exclusively, the present invention relates to mine roof support equipment for supporting mine roadway roofs.

One known such mine roof support equipment comprises a rigid roof canopy including a framework of roof engaging beams and at least one upright extensible prop which urges the canopy towards the roof. Unfortunately, such equipment suffers from the disadvantage that when the roof canopy contacts the roof it is frequently subjected to unbalanced loading, due to point contact between the rigid canopy and the uneven surface of the mine roof. Thus the canopy tends to be deformed or damaged and thereafter tends not to support the mine roof correctly. In an attempt to overcome or reduce this problem, canopies have tended to be of a complicated bulky construction which tends to block the view of machine operators working beneath the canopies.

An object of the present invention is to provide mine roof support equipment which overcomes or reduces the above mentioned disadvantage.

According to the present invention mine roof support equipment comprises a canopy, at least one upright member for supporting the canopy and at least one inflatable, deformable member supported by the canopy.

Preferably, the canopy comprises a framework of parallel beams interconnected by spacer means and in which case the spacer means constitutes a deck upon which the inflatable, deformable member is supported.

Conveniently, the spacer means are elongated strut elements secured at their ends to the beams.

Advantageously, the canopy comprises at least one beam arranged normal to the said parallel beams and in which case the upright member may act on the said one beam.

Preferably, the upright member is non extensible.

The equipment may comprise an air compressor adapted to inflate and/or deflate the deformable member.

The upright member may be mounted on a movable base which may comprise a mining machine. Alternatively, the base may be floor mounted.

By way of example only, two embodiments of the invention will be described with reference to the drawings accompanying the Provisional Specification in which.

Figure 1:
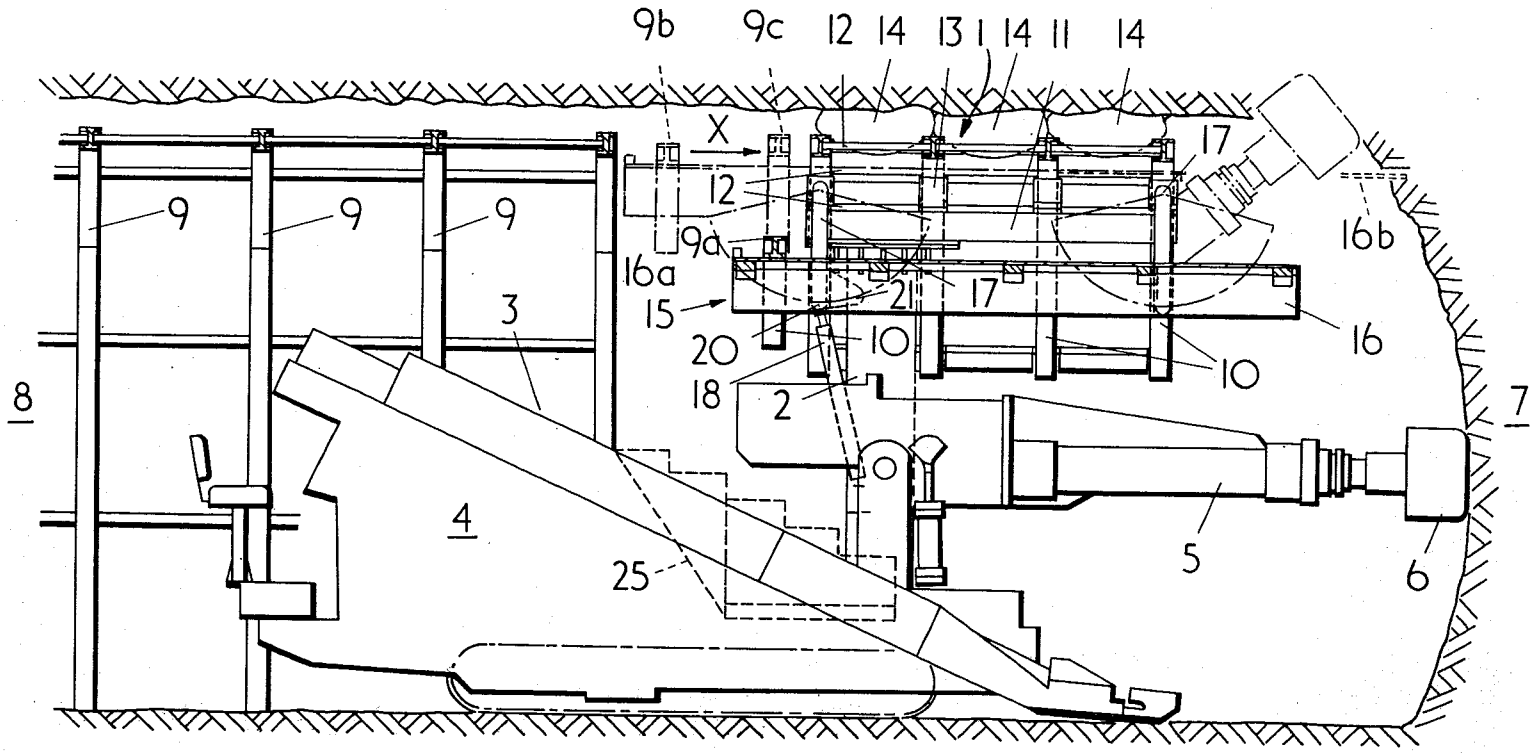
FIG. 1 is a side elevation, partly in section, of a first embodiment of mine roof support equipment constructed in accordance with the present invention and shown in an operational position.
Figure 2:
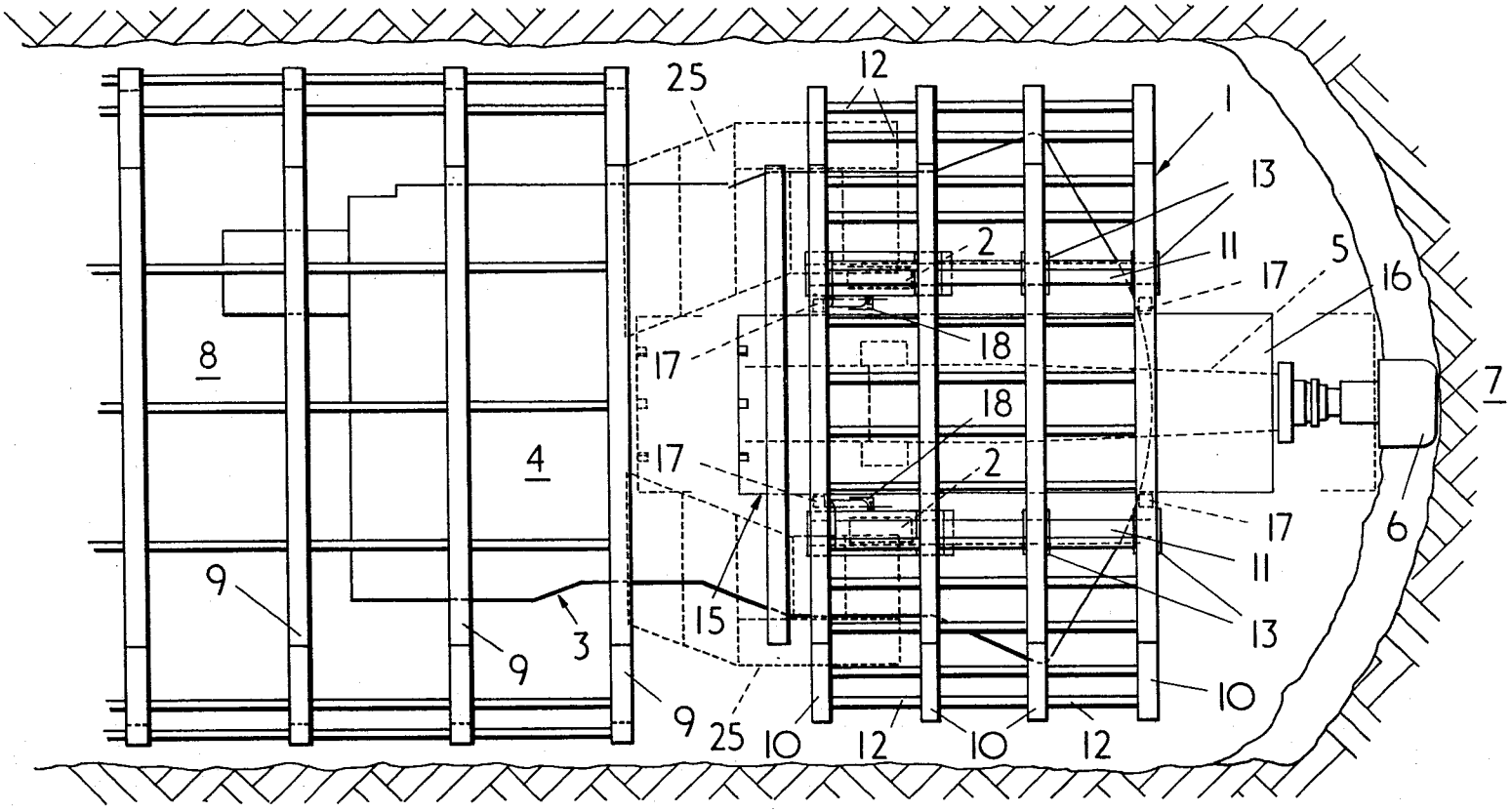
FIG. 2 is an incomplete plan of FIG. 1.
Figure 3:
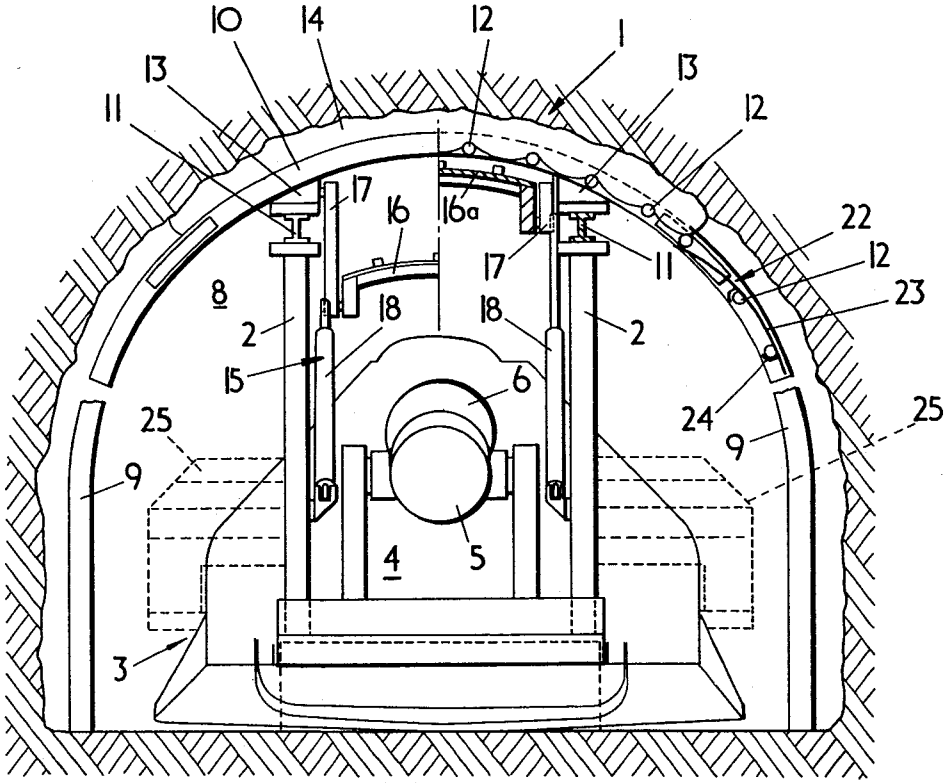
FIG. 3 is a front view, partly in section, of FIG. 1.

Referring to FIGS. 1 to 3 of the drawings, the first embodiment of underground mine roof support equipment comprises a canopy 1 supported on two non-extensible props 2 mounted on an underground mining machine 3. The machine comprises a crawler track-mounted body 4 and a boom 5 carrying a rotary cutter head 6 which is adopted to excavate rock from a working face 7 so as to extend a roadway 8. As the machine advances with the excavated working face, arch roof supports 9 are assembled and installed behind the machine so as to permanently support the mine roof of the roadway. The portion of the mine roof between the last set arch roof support 9 and the working face i.e. the roof in the vicinity of the machine, is supported by the said mine roof support equipment.

The canopy of the mine roof support equipment comprises a framework of parallel "I" section beams 10 which extend across the roadway and which are interconnected by two "I" section joists 11 and a plurality of struts 12 secured to the webs of the beams. Mounting-brackets 13 are provided at the intersections of the beams with the joists. The joists are supported by the two upright props 2 mounted on the body 4 of the machine 3.

Three inflatable, deformable members 14 (not shown in FIG. 2) are supported on the canopy 1, each member 14 being located between two adjacent parallel beams 10 and being supported on a deck constituted by the struts 12. The struts are spaced sufficiently close to one another to ensure adequate support for the member.

The deformable members 14 are fed via a control valve assembly (not shown) from a common air compressor (not shown) mounted on the machine's body 4 or in the roadway behind the machine 3. The control valve assembly controls deflation of the members as well as inflation and non return valves are provided to ensure that if the deformable member is punctured the other two members remain inflatable.

The roof support equipment also comprises a dual-purpose mechanism 15 for erecting the arch roof supports 9 and for providing temporary roof support over the cutter head 6 when it becomes necessary for an operator to replace cutting elements on the cutter head. The mechanism 15 comprises a platform 16 pivotally supported by four links 17 pivotally mounted on the mounting-brackets 13 associated with the rear and leading beams 10. Movement of the platform 16 is controlled by two hydraulic rams 18 pivotally interconnected between the platform and the two upright props 2. The rear of the platform provides a location for the upper or crown section of the arch roof support to be next set along the roadway. The section is first placed on the platform when in its lower position as indicated by **9*a* in FIG. 1. When the machine has advanced sufficiently for an arch roof support to be set behind the machine the platform is raised as indicated by broken line 16*a* in FIG. 1, the section is now in the position as indicated by 9*b* in FIG. 1. The section is then slid along the platform and indicated by the arrow X to the position indicated by 9*c* in FIG. 1**. With the upper or crown section in this position, the side sections (not shown) are assembled and struts are arranged between the newly set arch roof support and the last set arch roof support. Thus an effectively continuous support extends along the roadway. The platform is then lowered and lagging is then fed between the newly erected arch and its predecessor to complete the arch erection cycle.

When the cutter head 6 is in a lowered position the platform of the mechanism 15 can be raised to a position indicated by broken line 16*b* in FIG. 1 where it provides roof cover over the cutter head. This enables an operator to safely work in the vicinity of the cutter head if, for example, it is required to inspect or change the cutter elements on the cutter head. In order to raise the platform to its position 16*b* it is first necessary to disconnect the hydraulic rams 18 from connection points 20 on the platform 16 (see FIG. 1) and to reconnect the rams to connection points 21. After the operator has finished working on the cutter head the rams 18 must be reconnected to the connection points 20.

Spill plates 22 (see FIG. 3) are provided along each side of the canopy to ensure that any broken rock falling from the mine roof is deflected away from the operators towards the side of the roadway. Each of the spill plates comprise a flat plate 23 which is threaded through the struts as shown in FIG. 3 and two projections 24 which are bent over the adjacent struts to fix the flat plate in position.

Steps 25 are provided on the track mounted base to enable the operators to reach the arch roof support currently being set when the platform is in the raised position.

In use, with the machine adjacent to the working face as shown in the drawings with its cutter head sumped into the working face, the deformable members 14 are inflated so that the mine roof above the canopy is supported. When the machine has extracted a complete strip of rock from the working face by making repeated traverses across the face, the deformable members 14 are completely or partially deflated. When completely or partially deflated, the resistance of members 14 to the mine roof is lowered and permit the machine to advance along the roadway until the cutter head is in a position to win the next strip of rock from the working face. Once the machine is in the advanced position the deformable members are inflated so as to provide roof support over the machine which now wins the next strip. While the machine is winning the next strip under the control of one operator, other operators can set an arch roof support to support the roadway immediately behind the temporary support structure.

As the machine advances along the roadway repeatedly winning strips of rock from the working face, the procedure for advancing the canopy is repeated so that the mine roof above the machine is supported.

It will be seen that the first embodiment of mine roof support equipment anchors the machine during cutting.

Figure 4:
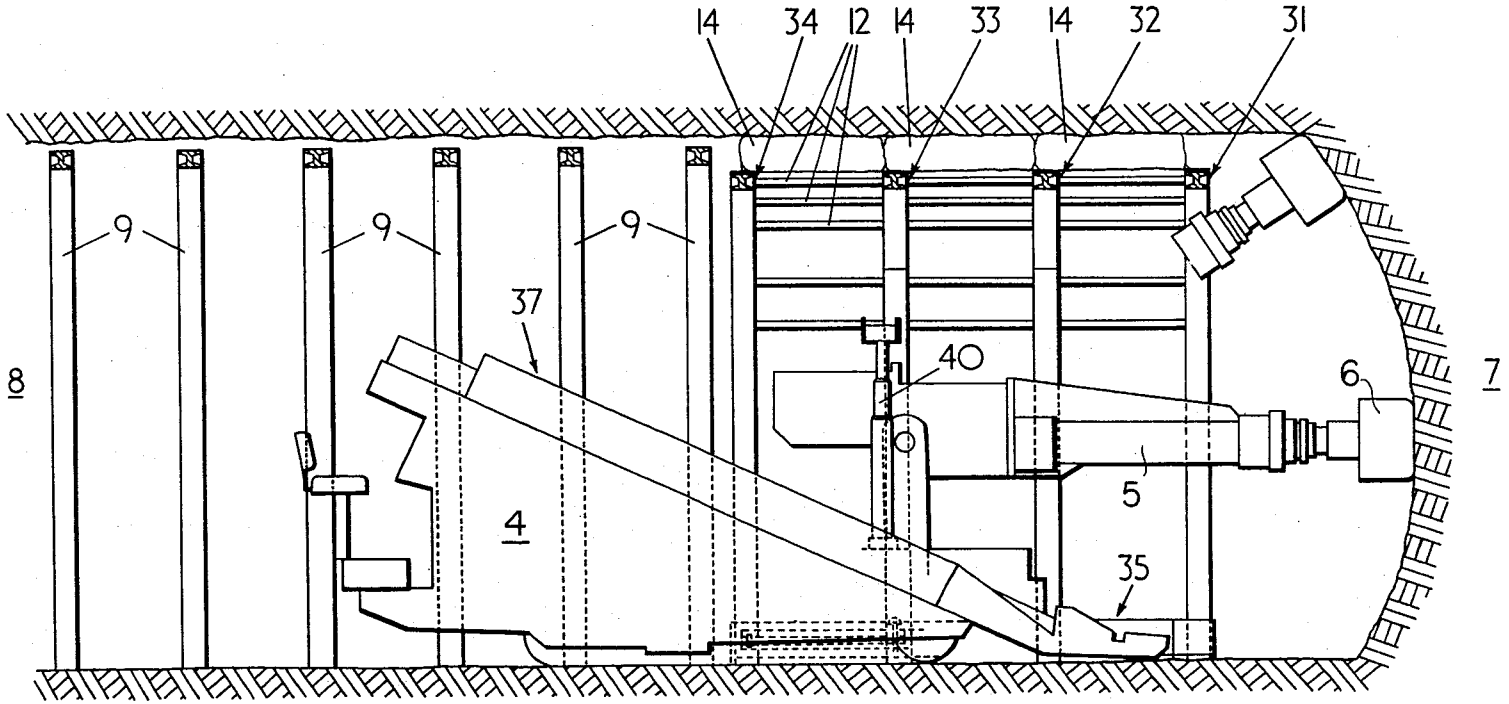
FIG. 4 is a side elevation, partly in section, of a second embodiment of mine roof support equipment constructed in accordance with the present invention and shown in an operational position.
Figure 5:
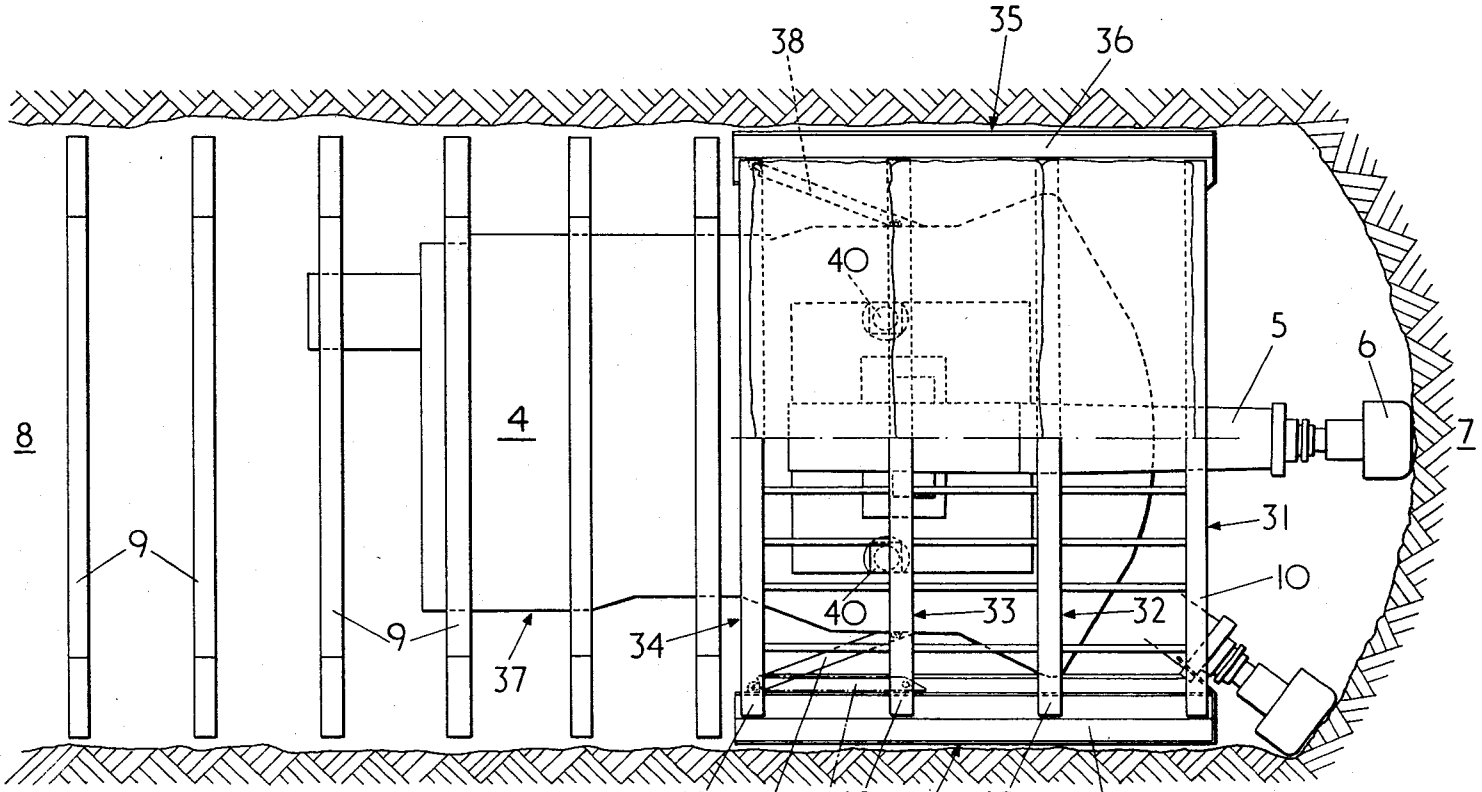
FIG. 5 is an incomplete plan of FIG. 4.
Figure 6:
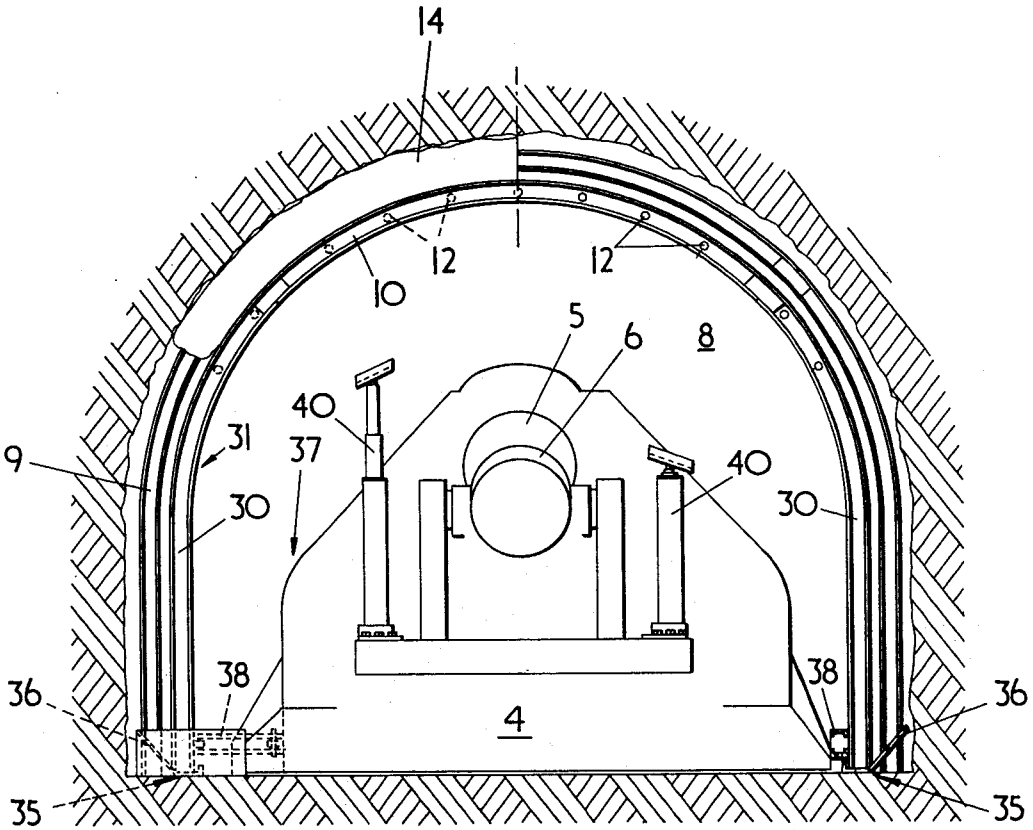
FIG. 6 is a front view, partly in section, of FIG. 4.

Referring now to FIGS. 4 to 6 of the drawings which show the second embodiment of roof support equipment, this embodiment is similar to the first described embodiment except that the equipment is floor mounted. The same reference numbers have been used for similar items as in FIGS. 1 to 3.

In the second embodiment the canopy 1 is of similar construction to that of the first embodiment except the joist 11 and upright props 2 of the first embodiment have been replaced by beam sections 30 connected to each end of the parallel beams 10 so as to form four similar arch section assemblies 31, 32, 33 and 34. The assemblies are interconnected by struts 12 which form decks for the three inflatable, deformable members 14.

The beam sections 30 along each side of the equipment are mounted on a runner 35 adapted to slide along the mine floor when the equipment is being advanced. The runners 35 are provided with ramp plates 36 which guide any broken rock falling behind the beam sections 30 towards the floor of the roadway where it can easily be removed.

Each of the runners 35 is connected to the machine 37 by links 38 which are pivotally connected to the adjacent side of the machine and to the runner and which enable the machine to advance the roof support equipment along the roadway towards the working face. When the equipment is not being advanced, the links 38 are disconnected from the machine and moved into a position parallel with the runner as indicated at 38*a* in FIG. 5.

The procedure for advancing the second embodiment is similar to that previously described with reference to the first embodiment, the deformable members 14 being completely or partially deflated so that resistance of the equipment to the mine roof during advance is lowered and re-inflated after advance to the mine roof.

The second embodiment of mine roof support equipment has the advantage that the machine can move relatively to the equipment during the winning and loading operation.

The machine has two jacks 40 which are used to support and lift the crown-piece of the arch support currently being set.

It will be seen from the above description that the present invention provides mine roof support equipment which is simple and easy to operate and which avoids point loading and thus tends to reduce or eliminate permanent deformation of or damage to the roof canopy.

We claim:

1. Mine roof support equipment comprising a canopy, at least one upright member for supporting the canopy, and at least one inflatable, deformable member supported by the canopy, the canopy comprising a framework of parallel beams, spacer means interconnecting the parallel beams and constituting a deck supporting the inflatable, deformable member, a platform pivotally supported by links connected to the beams and rams connected to the platform and to the upright member for swinging and lifting the platform forward and rearward with respect to the movable base.

2. Equipment as claimed in claim 1, in which the canopy comprises at least one joist arranged normal to the said parallel beams, the upright member acting on the said beam.

3. Mine roof support equipment comprising a canopy, at least one upright member for supporting the canopy, a movable base for supporting the said upright member, the movable base comprising a runner connected to the upright member and a link connected to the runner for connecting the runner with a mining machine, and at least one inflatable, deformable member supported by the canopy, the canopy comprising a framework of parallel beams, spaced means interconnecting the parallel beams and constituting a deck supporting the inflatable, deformable member.

4. The mine roof support equipment of claim 1 further comprising a ramp plate connected to the runner and extending outward therefrom.

5. The mine roof support equipment of claim 3 further comprising a platform pivotally supported by links connected to the beams and rams connected to the platform and to the upright member for swinging and lifting the platform forward and rearward with respect to the movable base.

* * * * *